US007368213B2

(12) United States Patent
Nakayama et al.

(10) Patent No.: US 7,368,213 B2
(45) Date of Patent: May 6, 2008

(54) TONER AND FIXING DEVICE AND IMAGE FORMING DEVICE USING THE SAME

(75) Inventors: Shinya Nakayama, Numazu (JP); Fumihiro Sasaki, Fuji (JP); Satoshi Mochizuki, Numazu (JP); Akihiro Kotsugai, Numazu (JP); Yasuo Asahina, Numazu (JP); Osamu Uchinokura, Numazu (JP); Hisashi Nakajima, Numazu (JP); Sonoh Matsuoka, Numazu (JP); Takuya Saito, Numazu (JP); Tomoyuki Ichikawa, Kawasaki (JP); Koichi Sakata, Numazu (JP)

(73) Assignee: Ricoh Company, Limited, Tokyo (JP)

( * ) Notice: Subject to any disclaimer, the term of this patent is extended or adjusted under 35 U.S.C. 154(b) by 415 days.

(21) Appl. No.: 11/081,738

(22) Filed: Mar. 17, 2005

(65) Prior Publication Data

US 2005/0208411 A1 Sep. 22, 2005

(30) Foreign Application Priority Data

Mar. 19, 2004 (JP) ..... 2004-081162

(51) Int. Cl.
*G03G 9/00* (2006.01)

(52) U.S. Cl. ..... 430/109.4; 430/111.4; 430/110.2; 399/252

(58) Field of Classification Search ..... 430/109.4, 430/111.4, 110.2; 399/252
See application file for complete search history.

(56) References Cited

U.S. PATENT DOCUMENTS 6,221,549 B1 * 4/2001 Emoto et al. ..... 430/110.1
6,403,275 B1 6/2002 Kuramoto et al.
6,660,443 B2 * 12/2003 Sugiyama et al. ..... 430/108.4
6,821,697 B2 * 11/2004 Takayanagi et al. ..... 430/108.4

(Continued)

FOREIGN PATENT DOCUMENTS

EP 0 546 514 A1 6/1993

(Continued)

OTHER PUBLICATIONS

U.S. Appl. No. 10/645,804, filed Aug. 22, 2003, Tomita et al.

(Continued)

*Primary Examiner*—Mark A. Chapman
(74) *Attorney, Agent, or Firm*—Oblon, Spivak, McClelland, Maier & Neustadt, P.C.

(57) ABSTRACT

A toner containing toner particles having a core-shell structure containing a binder resin, a colorant and a release agent. The toner particles are prepared by dissolving or dispersing at least one of the binder resin and a precursor thereof in an organic solvent or a polymeric monomer and reacting the resultant in an aqueous medium for reaction, wherein the toner satisfies the following relationship: $\Delta Tm = Tm1 - Tm2 > 10$ ° C., wherein Tm1 represents half efflux temperature of the toner and Tm2 represents half efflux temperature of a toner which is prepared by melting and kneading the toner particles and wherein a content of the release agent existing close to the surface portion of the toner particles is from 7 to 30% by volume based on an entire portion close to the surface portion of the toner particles when the content is determined by Fourier Transform Infrared Spectroscopy Attenuated Total Reflection (FTIR-ATR) method.

19 Claims, 3 Drawing Sheets

U.S. PATENT DOCUMENTS

| | | | | |
|---|---|---|---|---|
| 6,835,517 | B2 | 12/2004 | Kondo et al. | |
| 7,056,638 | B1 * | 6/2006 | Tomita et al. | 460/108.8 |
| 2003/0165760 | A1 | 9/2003 | Higuchi et al. | |
| 2004/0115550 | A1 | 6/2004 | Sugiura et al. | |
| 2004/0142265 | A1 | 7/2004 | Tomita et al. | |
| 2004/0209181 | A1 | 10/2004 | Higuchi et al. | |
| 2004/0229143 | A1 | 11/2004 | Umemura et al. | |

FOREIGN PATENT DOCUMENTS

| | | |
|---|---|---|
| EP | 0 656 568 A1 | 6/1995 |
| EP | 1 308 790 A2 | 5/2003 |
| JP | 03/015858 | 1/1991 |
| JP | 10/207116 | 8/1998 |
| JP | 2002/006541 | 1/2002 |

OTHER PUBLICATIONS

U.S. Appl. No. 10/724,260, filed Dec. 1, 2003, Emoto et al.
U.S. Appl. No. 10/960,084, filed Oct. 8, 2004, Yamada et al.
U.S. Appl. No 11/080,542, filed Mar. 16, 2005, Uchinokura et al.
U.S. Appl. No. 11/685,872, filed Mar. 14, 2007, Uchinokura et al.
U.S. Appl. No. 11/852,778, filed Sep. 10, 2007, Nagatomo et al.
U.S. Appl. No. 11/853,490, filed Sep. 11, 2007, Miyamoto et al.
U.S. Appl. No. 11/857,791, filed Sep. 19, 2007, Kojima et al.

* cited by examiner

TONER AND FIXING DEVICE AND IMAGE FORMING DEVICE USING THE SAME

BACKGROUND OF THE INVENTION

1. Field of the Invention

The present invention relates to a toner for use in developing latent electrostatic images formed in the electrostatic photocopying process performed by a photocopier, a facsimile machine, a printer, etc and also relates to a fixing device and an image forming apparatus using this toner.

2. Discussion of the Background

An image forming apparatus is typically used for image forming methods such as electrophotography, electrostatic recording and electrostatic printing. The image forming methods typically include the following processes:

(1) A latent electrostatic image formed on an image bearing member such as photoreceptors or dielectric materials is developed with a developer including a toner to form a toner image on the image bearing member (developing process);

(2) the toner image is transferred on a receiving material such as recording papers optionally via an intermediate transfer medium (transfer process); and (3) the toner image is fixed on the receiving material upon application of heat and/or pressure, or the like (fixing process).

In the fixing process mentioned above, a pair of fixing members having a roller form or a belt form including a heater in its interior fix the toner on a recording material upon application of heat and pressure while pinching the receiving material. When the heating temperature is too high, the toner excessively fuses, which causes a problem in that the fused toner is attached to the fixing member, i.e., hot offset problem. When the heating temperature is too low, the toner does not sufficiently fuse, and thus the fixing is not sufficient. To save energy and reduce the size of an image forming apparatus, a toner having a high hot offset temperature (anti hot offset property) and low fixing temperature (low fixing temperature property) is desired. In addition, the toner is necessary to be free from blocking when the toner is in store or an atmosphere in the apparatus (high temperature preservability).

Especially, to obtain good images, full color photocopiers and full color printers require good gloss and color mixture properties. Therefore, the toner is necessary to have a low viscosity. Consequently, the toners used are polyester toner binders having a sharp melt property. However, these toners easily cause hot offset and thus silicone oil, etc., is usually applied to the fixing member included in a full color image forming apparatuses. To apply such silicone oil to the fixing member, a device such as an oil tank and an oil application device is required. Consequently the image forming apparatus is jumboized and complicated. Further, such oil causes deterioration of the fixing member and requires maintenance on a regular interval basis. In addition, oil attachment to receiving materials such as plain copy papers and transparent films is inevitable. The color tone can be degraded by oil especially when the oil is attached to a transparent film.

Therefore, instead of applying oil to the fixing member, a release agent is typically added to a toner to avoid that toner attachment problem. However, the release effect of a release agent greatly depends on the dispersion state thereof in a binder resin. When a release agent compatible with a binder resin is used, the release agent does not exhibit the release effect. To exhibit its release effect, release agents incompatible with a binder resin are preferably used to form domains of the release agents.

In addition, the dispersion state of a release agent as domain particles is also important. When a release agent is not well dispersed but agglomerated within a toner particle, the release agent does not have a sufficient release effect. Therefore, in order for a release agent to sufficiently exhibit its release effect, it is desired that the release agent be also locally dispersed close to the surface of a toner particle. However, when the ratio of the release agent present close to the surface of a toner particle increases, the release agent may protrude from the surface of the toner particle even when the release agent is fully dispersed. When the release agent protrudes from the surface of toner particles, the toner particles agglomerate, thereby reducing the fluidity of the toner particle. When a two component developer including a toner and a magnetic carrier is used, such release agents protruding from the surface of toner particles transfer to the magnetic carrier over a long period of use, resulting in deterioration of chargeability. Such release agents may transfer to an image bearing member, thereby causing filming thereon. Further, high temperature preservability of the toner deteriorates, meaning that the toner is not stable for a long period of time. In contrast, when the particle diameter of a release agent in a dispersion state is too small, the release agent is excessively and minutely dispersed, resulting in insufficiency of its release effect. Therefore, the content of a release agent added to a toner and its dispersion state therein are extremely important.

Japanese Patent No. 2663016 (hereinafter referred to as JPN) discloses a toner manufactured by suspension polymerization of a compound having a polar radical and a polymeric monomer having a release agent in an aqueous medium. The toner obtained can contain a release agent having a low melting point. A toner manufactured by a pulverization method cannot contain such a release agent. It is said in the literature that, unlike polar components, non-polar components such as a release agent do not exist locally in the proximity of the surface of a toner particle but take a pseudo capsule structure the surface of which is covered by polar components. However, distribution state of the release agent in the toner particle is not analyzed and unknown. JPN 3225889 discloses a toner which contains a release agent in an amount of 0.1 to 40% by weight. In addition, the weight ratio of the release agent protruding from the surface of the toner particle to all the components protruding therefrom is 1/100 to 10/100. The ratio of the release agent protruding from the surface of the toner particle is measured by Electron Spectroscopy for Chemical Analysis (ESCA) and determined. However, the analysis by ESCA is limited to the depth of around 0.1 μm from the outermost surface of a toner particle. Therefore, it is impossible to know the dispersion state of the release agent existing further inside of the toner particle which can suitably exhibit its release effect in the fixing process. Published unexamined Japanese Patent Application No. 2002-6541 discloses a toner encapsulating a release agent. The release agent is localized close to the surface of the toner particle. However, the detailed dispersion state of the release agent present close to the surface of the toner particle is unknown.

Because of these reasons, a need exists for a toner which can prevent the occurrence of offset even when a fixing roller on which no amount of or an extremely small amount of oil is applied is used, which can have excellent high temperature preservability when stored in an image forming apparatus for a long period of use and which can produce color images with suitable gloss and excellent color reproducibility.

SUMMARY OF THE INVENTION

Accordingly, an object of the present invention is to provide a toner which has a high offset temperature to reduce the occurrence of offset while its low fixing temperature remains low and which has an increased high temperature preservability to prevent blocking of the toner even when the toner is stored in an image forming apparatus for a long period of use and further a toner in which a release agent is uniformly dispersed and is localized close to the surface of the toner to improve color reproducibility of produced images. Another object of the present invention is to provide a fixing device and an image forming apparatus using the toner to produce an image having good gloss and good color reproduction.

Briefly these objects and other objects of the present invention as hereinafter will become more readily apparent and can be attained by a toner including toner particles having a core-shell structure. The toner particle contains a binder resin, a colorant and a release agent. The toner particles are preferably prepared by dissolving or dispersing at least one of the binder resin and a precursor thereof in an organic solvent or a polymeric monomer and reacting the resultant in an aqueous medium for reaction such as elongation reaction and cross-bridging reaction. Further, the toner particles have a core-shell structure. In addition, the toner satisfies the following relationship: $\Delta Tm = Tm1 - Tm2 > 10°$ C., wherein Tm1 represents half efflux temperature of the toner and Tm2 represents half efflux temperature of a toner which is prepared by melting and kneading the toner particles and wherein the content of the release agent existing close to the surface portion of the toner particles is from 7 to 30% by volume based on the entire portion close to the surface portion of the toner particles when the content is determined by Fourier Transform Infrared Spectroscopy Attenuated Total Reflection (FTIR-ATR) method.

It is preferred that the core portion of the toner particle mainly is formed of a low molecular weight polyester resin and the shell portion of the toner particle mainly is formed of a high molecular weight polyester resin.

It is still further preferred that the weight ratio of the low molecular weight polyester resin to the high molecular weight polyester resin is from 5/100 to 30/100.

It is still further preferred that the low molecular weight polyester resin has a peak molecular weight of from 1,000 to 30,000.

It is still further preferred that the low molecular weight polyester resin has a glass transition temperature (Tg) of from 40 to 70° C.

It is still further preferred that the toner has a glass transition temperature (Tg) of from 45 to 75° C.

It is still further preferred that Tm1 is from 145 to 200° C. and Tm2 is from 110 to 135° C.

It is still further preferred that the weight ratio of the release agent contained in the toner particle is from 3/100 to 20/100 when measured by differential scanning calorimetry (DSC) method.

It is still further preferred that at least a polymer having a portion reactive with a compound having an active hydrogen group is used as a precursor to form the toner particles through cross-bridge reaction with a cross bridging agent or elongation reaction with an elongation agent.

It is still further preferred that the cross-bridging agent or the elongation agent is a tertiary amine compound.

It is still further preferred that the toner particle has a volume average particle diameter (Dv) of from 3.0 to 8.0 μm and the ratio (Dv/Dn) of the volume average particle diameter (Dv) to a number average particle diameter (Dn) is from 1.00 to 1.40.

It is still further preferred that the toner particle has an average circularity not less than 0.94.

It is still further preferred that the toner particle has a form factor SF-1 of from 100 to 180 and a form factor of SF-2 of from 100 to 180.

It is still further preferred that the toner particle has a spindle form determined by the major axis length r1, the minor axis length r2 and the thickness length r3, wherein the ratio (r2/r1) of the minor axis length r2 to the major axis length r1 is from 0.5 to 1.0 and the ratio of (r3/r2) of the thickness length r3 to the minor axis length r2 is from 0.7 to 1.0.

As another aspect of the present invention, a fixing device is provided which contains a fixing roller configured to fix an image visualized by a toner on a recording material upon application of at least one of heat and pressure, a pressing roller configured to fix the toner image on the recording material upon application of at least one of heat and pressure and a cleaning roller configured to clean the one of the fixing roller and the pressing roller. The toner contains toner particles including a binder resin, a colorant and a release agent. The toner particles are preferably prepared by dissolving or dispersing at least one of the binder resin and a precursor thereof in an organic solvent or a polymeric monomer and reacting the resultant in an aqueous medium for reaction. Further, the toner particles have a core-shell structure. In addition, the toner satisfies the following relationship: $\Delta Tm = Tm1 - Tm2 > 10°$ C., wherein Tm1 represents half efflux temperature of the toner and Tm2 represents half efflux temperature of a toner which is prepared by melting and kneading the toner particles and wherein the content of the release agent existing close to the surface portion of the toner particles is from 7 to 30% by volume based on an entire portion close to the surface portion of the toner particles when the content is determined by Fourier Transform Infrared Spectroscopy Attenuated Total Reflection (FTIR-ATR) method.

It is preferred that, in the fixing device of the present invention, the core portion of the toner particle mainly contains a low molecular weight polyester resin and the shell portion of the toner particle mainly contains a high molecular weight polyester resin.

As another aspect of the present invention, an image forming apparatus is provided which contains an image bearing member configured to bear a latent electrostatic image, a charging device configured to uniformly charge a surface of the image bearing member, an irradiating device configured to irradiate the surface of the image bearing member with light based on image data and to write the latent electrostatic image thereon, a developing device configured to visualize the latent electrostatic image borne on the surface of the image bearing member with a toner, a transfer device configured to transfer the visualized image on the surface of the image bearing member to a recording medium, a cleaning device configured to remove residual toner on the image bearing member and a fixing device configured to fix the visualized toner image on the recording medium upon application of at least one of heat and pressure. The fixing device includes a fixing roller, a pressing roller and a cleaning roller configured to clean at least one of the fixing roller and the pressing roller. The toner contains toner particles including a binder resin, a colorant and a release agent. The toner particles are preferably prepared by dissolving or dispersing at least one of the binder resin and a precursor thereof in an organic solvent or a polymeric monomer and reacting the resultant in an aqueous medium for reaction. Further, the toner particles have a core-shell structure. In addition, the toner satisfies the following relationship: $\Delta Tm = Tm1 - Tm2 > 10°$ C., wherein Tm1 represents half efflux temperature of the toner and Tm2 represents half efflux temperature of a toner which is prepared by melting and kneading the toner particles and wherein the content of the release agent existing close to the surface portion of the toner particles is from 7 to 30% by volume based on an entire portion close to the surface portion of the toner particles when the content is determined by Fourier Transform Infrared Spectroscopy Attenuated Total Reflection (FTIR-ATR) method.

It is preferred that, in the image forming apparatus of the present invention, the core portion of the toner particle mainly contains a low molecular weight polyester resin and the shell portion of the toner particle mainly contains a high molecular weight polyester resin.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
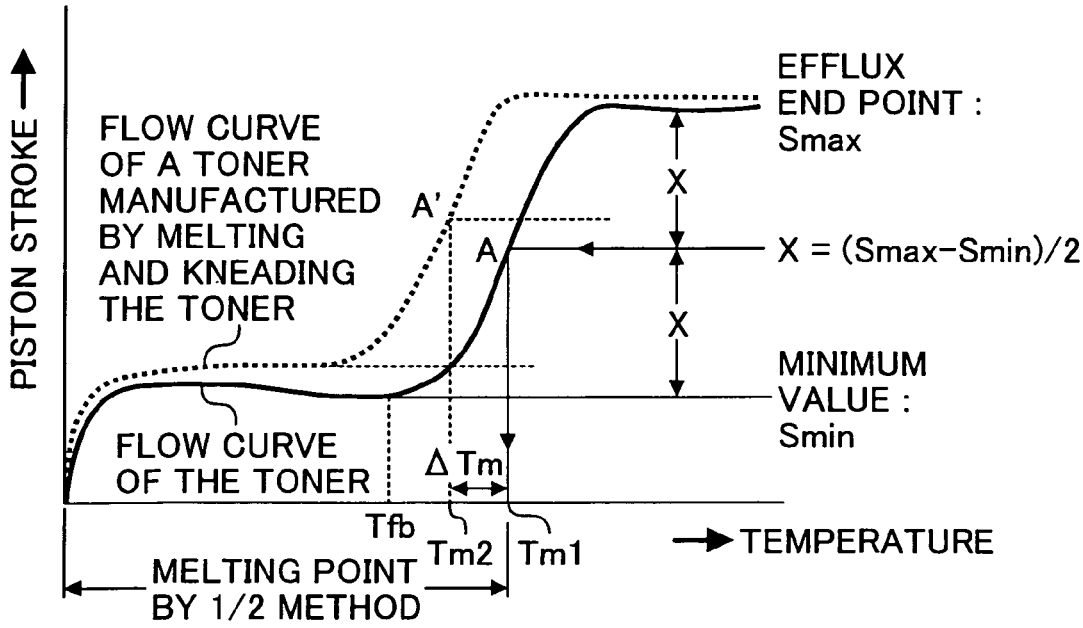
FIG. 1 is a graph for explaining the measurement of half efflux temperature by an elevated flow tester.

The present invention will be described below in detail with reference to several embodiments and accompanying drawings.

The toner of the present invention contains a binder resin, a colorant and a release agent. The toner particles are manufactured by dissolving or dispersing at least the binder resin in an organic solvent to form the toner particles in an aqueous medium.

The toner obtained has a core-shell structure. In the core-shell structure, the shell portion of the toner surface mainly contains polymer resin components and is relatively hard in comparison with the core portion in the center of the toner. By hardening the shell portion, the toner can avoid softening (blocking) upon receipt of heat when the toner is used in an image forming apparatus for a long time. In addition, by hardening the shell portion of the toner surface, it is possible to reduce the amount of the release agent detached from the toner surface. Further, the core portion of the toner includes more low molecular weight components than the shell portion forming the toner surface does. Thereby, when the shell portion is destroyed upon application of heat and/or pressure, the low molecular weight components in the core portion flow out so that the low fixing temperature can be lowered.

The largest cause of the hot offset lies in a resin having a low softening point in a toner. Therefore it is essential that such a resin having a low softening point has a suitable efflux temperature. A toner typically contains other components such as a release agent and a resin having a high density cross-bridging structure such as gel component. To measure efflux temperature totally, an elevated flow tester is suitable. Among thermal characteristics measured by a flow tester, when half efflux start temperature is high, hot offset resistance tends to be good. However their correlation is not high. The reason is, for example just measuring thermal characteristics of the toner is not sufficient to measure the thermal characteristics of when heat and pressure are sufficiently applied at a fixing portion because there are various kinds of toners having different structures such as a core-shell structure in which a resin having a high cross-bridging density is localized on the toner surface and a resin having a low softening temperature is present in the core of the toner and a structure in which a gel component is present in a resin having a low softening temperature in a sea-island manner. Therefore, although a toner having a core-shell structure as is often with the case with polymerized toners has a sufficiently high half efflux start temperature, the core-shell structure is crushed at fixing so that a resin having a low softening point in the core of the toner flows outside and causes hot offset. Therefore, when a toner component is sufficiently fused and dispersed after sufficient fusion, shearing and kneading, the half efflux start temperature of the toner prepared by melting and kneading has a significant correlation with hot offset resistance. It is found that extremely high hot offset resistance is obtained especially under the condition that $\Delta Tm = Tm1 - Tm2 > 10°$ C., wherein Tm1 represents half efflux temperature of a toner containing toner particles and Tm2 represents half efflux temperature of a toner which is prepared by melting and kneading the toner particles and wherein the content of the release agent existing in the close area is from 7 to 30% by volume based on an entire portion of the close to the surface portion of the toner particles when the content is determined by Fourier Transform Infrared Spectroscopy Attenuated Total Reflection (FTIR-ATR) method.

There is no specific limit for methods of manufacturing a toner having a core-shell structure. To have the mixture ratio of a resin having a low softening point and a gel portion and to control the structure with ease while a good dispersion property is good, the manufacturing method adopted in the present invention is as follows: dissolve or disperse a prepolymer having a portion reactive with a compound having an active hydrogen group, a release agent and a colorant in an organic solvent; disperse the solution or dispersion in an aqueous solution: subsequent to or during cross-bridging or elongating the prepolymer having a portion reactive with a compound having an active hydrogen group, remove the organic solvent: wash the resultant with water and dry the resultant. Also it is found that, by adjusting the kind of a resin, acid value, molecular weight and glass transition temperature, further preferred effects are exhibited by the present invention. The detail will be described later.

The toner of the present invention satisfies the following relationship: $\Delta Tm(=Tm1 - Tm2) > 10°$ C., wherein Tm1 represents the half efflux temperature of the toner measured by an elevated flow tester method and Tm2 represents the half efflux temperature of the toner which has been additionally kneaded before measuring. FIG. 1 is a diagram for explaining the half efflux temperatures Tm1 and Tm2 when measured by an elevated flow tester. The measuring conditions are as follows:

Measuring Conditions
Load: 5 Kg/cm$^2$
Temperature rising speed: 3.0° C./min.
Dye diameter: 1.00 mm
Dye length: 10.0 mm Elevated flow testers such as CFT500D (manufactured by Shimazu Corporation) can be used. The flow curves measured by this flow tester is shown in FIG. 1. Each temperature can be read from these flow curves. The full line in FIG. 1 represents a flow curve of the toner, and the dotted line represents a flow curve of a toner manufactured by melting and kneading the toner particles of the toner. As for the flow curve represented by the full line, Tfb represents efflux starting temperature and the melting point by 1/2 method in the figure represents T1/2 temperature. T1/2 temperature represents the temperature of when the piston stroke is Smin plus X, wherein X is (Smax−Smin)/2, Smin represents the piston stroke at the efflux starting point and Smax represents the piston stroke at the efflux ending point. T1/2 temperature by a flow tester typically represents the melting point of a sample to be measured. Such a manner in which the melting point is represented is referred to as 1/2 method in the flow tester measuring method. In the figure, ΔTm represents the difference between the melting point Tm1 of the toner and the melting point Tm2 of a toner manufactured by melting and kneading the toner particles of the toner.

The temperature difference ΔTm between Tm1 (half efflux temperature of the toner) and Tm2 (half efflux temperature of the toner melted and kneaded, i.e., a toner manufactured by melting and kneading the toner particles of the toner) is greater than 10° C. The toner melted and kneaded represents the toner which has been kneaded by a kneader such as a laboplastomill and a single- or double-axis extruder. In the case of Tm1 (half efflux temperature of the toner not kneaded), the efflux temperature is measured for the toner still having a core-shell structure so that Tm1 greatly depends on the shell portion mainly containing polymer components. In contrast, in the case of Tm2 (half efflux temperature of the toner kneaded), the efflux temperature is measured for the toner the core-shell structure of which has been destroyed so that Tm2 greatly depends on the core portion mainly containing low molecular weight components. Therefore, Tm1 and Tm2 satisfy the following relationship: Tm1>Tm2.

Especially, when the temperature of a fixing device is lower than the evaporation temperature of water absorbed in a recording medium, the heat of the fixing temperature is not absorbed for evaporating the water so that the fixing device can fix an image at a low temperature. Therefore, the toner is necessary to start flowing at around this temperature. The half efflux temperature Tm1 (for the toner not kneaded) is preferably from 145 to 200° C., more preferably from 145 to 170° C. and further more preferably from 145 to 160° C. The half efflux temperature Tm2 (for the toner kneaded) is preferably from 110 to 135° C. and more preferably from 110 to 125° C. When Tm1 is too low, the high temperature preservability of the toner is poor so that it is impossible to store and use the toner in an image forming apparatus for a long time. When Tm1 is too high, it is impossible to perform low temperature fixing by a fixing roller. In addition, when Tm2 is too low, the toner tends to flow from a cleaning roller, resulting in contamination of the reverse side of a recording medium. When Tm2 is too high, the toner hardens before the toner is retrieved by a cleaning roller, meaning low temperature fixing is impossible.

Further, the temperature difference ΔTm is necessary to be greater than 10° C. As the high temperature preservability between the core portion and the shell portion increases, the temperature difference ΔTm increases. As the high temperature preservability between the core portion and the shell portion decreases, the temperature difference ΔTm decreases. Having the temperature difference ΔTm greater than 10° C. means that the toner particle has a sufficient core-shell structure. Thereby, the toner has a good high temperature preservability and does not block in an image forming apparatus. In addition, the surface of the toner is mechanically strong. Therefore, a resin forming the surface functions as a shell even when a low molecular weight resin is used for the toner, resulting in reduction of toner contamination for an image bearing member, a developing device, a carrier, etc.

The toner of the present invention can have a good combination of high temperature preservability and low temperature fixing property because the core portion of a toner has a sufficient low softening property in comparison with the shell portion to lower the softening temperature of the toner upon application of heat and/or pressure. When the temperature difference ΔTm is too small, the difference of high temperature preservability between a core portion and a shell portion is not sufficient, meaning that it is impossible to have a good combination of high temperature preservability and low temperature fixing property. When the temperature difference ΔTm is greater than 20° C., the toner does not block even when image formation is continuously performed for a long time in a high-temperature and high-humidity environment. Therefore, the temperature difference ΔTm is preferably greater than 20° C.

The volume amount of a release agent existing close to the surface of the toner of the present invention is from 7 to 30% when measured by Fourier Transform Infrared Spectroscopy Attenuated Total Reflection (FTIR-ATR) method. In the FTIR-ATR method, according to the measuring principles thereof, its analyzable depth is 0.3 μm. Thereby, it is possible to obtain the relative content ratio of a release agent in the area 0.3 μm deep down from the toner surface. The measuring method is as follows: press 3 grams of a toner with a load of 6 ton for one minute using an automatic pellet molding device (Type M No. 50 BRP-E manufactured by Maekawa Testing Machine Co.) to obtain a pellet with 40 mm Φ and a thickness of about 2 mm); and measure the surface of the toner pellet by FTIR-ATR method. The micro FTIR device used is Spectrum One (manufactured by Perkin Elmer Corporation) to which a MultiScope FTIR unit is set. The sample is measured 20 times using micro ATR of a germanium crystal having a diameter of 100 μm with an infrared incident angle of 41.5° and a resolving power of 4 cm$^{-1}$. At this point, non-overlapped wavelengths are selected to identify each material such as a binder resin as a base material and a release agent as a target material. Each material will be described later. Here is just an example: select Peak Pwax (e.g., 2850 cm$^{-1}$ for carnauba wax) obtained from a release agent and Peak Presin (e.g., 828 cm−1 for a polyester resin) obtained from a binder resin; preliminarily make the intensity ratio (Pwax/Presin) of Pwax to Presin and the analytical curve; and measure the relative volume content of the release agent existing close to the toner surface using this intensity ratio (Pwax/Presin). The average of four measurement results is determined as the volume content of a release agent while the measuring points are changed each time. With regard to the toner of the present invention, a release agent contained in the toner particle therein is not locally present on the outermost surface of the toner while protruding therefrom but is uniformly dispersed while existing close to the outermost surface of the toner particle. Close to the outermost surface of the toner particle represents the area (hereinafter referred to as the close area) which occupies from the outermost surface of the toner particle to the portion having a depth of around 0.3 μm from the outermost surface of the toner particle. In addition, since the release agent existing in the close area, which is measured and determined by the analysis by FTIR-ATR method, tends to ooze to the toner surface, the occurrence of toner offset can be effectively prevented by the releasability of the release agent.

The relative amount of a release agent existing close to the surface of a toner particle obtained by FTIR-ATR method is preferably 7 to 30% by volume based on the intensity ratio (Pwax/Presin) as the weight content of the release agent existing close to the surface of a toner particle. When the relative amount of a release agent is too small, the amount of the release agent existing close to the surface of a toner particle is so small that its release effect is not sufficient at the time of fixing. When the relative amount of a release agent is too large, it is not preferred because the amount of the release agent existing close to the surface of a toner particle is so large that the release agent easily emerges to the surface of a toner particle and thus transfers to carrier particles, resulting in decrease in the length of life of the developer. To have a good combination of hot offset resistance property at fixing and chargeability, developability and high temperature preservability, it is preferred that the content of a release agent is 7 to 30% by volume based on the intensity ratio mentioned above.

The toner of the present invention contains a binder resin and/or a precursor thereof, a colorant, and a release agent. The precursor of a binder resin includes polymeric monomers and polymers which are to form a binder resin through reaction. Polymerized toners having the structure mentioned above can have a structure of the core portion formed by a resin having a large molecular weight which can contribute to having a good high temperature preservability and the shell portion formed by a resin having a small molecular weight which can contribute to having a good low fixing temperature property. In addition, the occurrence of offset can be prevented by the release agent oriented close to the toner surface.

In addition, the toner of the present invention has a weight ratio of the polyester resin having a high molecular weight contained in the shell portion to the polyester resin having a low molecular weight contained in the core portion of from 5 to 30%. When the weight ratio is too small, the thickness of the shell portion is thin. Such toner particles are crushed at the time of stirring and mixing, resulting in deterioration of high temperature preservability thereof. When the weight ratio is too large, the thickness of the shell portion is thick. Such toner particles are not cracked upon application of heat and/or pressure, resulting in degradation of fixability thereof. This weight ratio can be controlled by a non-modified polyester, a polyester polymer, an addition amount of an elongation agent and the length of reaction time, which will be described later. Using the fact that a gelatinized polyester resin having a high molecular weight is not dissolved in tetrahydrofuran (THF), the weight of the polyester resin having a high molecular weight can be measured. After eliminating the amount of the release agent measured by a DSC method, the weight ratio is obtained under the condition that a colorant and other materials are contained therein. In the present invention, the gelatinized amount is measured as follows: weigh 1 gram of a toner; add 100 gram of tetrahydrofuran (THF) to the toner; leave the resultant at 10° C. for 20 to 30 hours; filtrate a gel formed and set by swelling to exposure to THF with a filter paper; heat the separated gel portion at 120° C. for three hours; subsequent to volatilizing the absorbed THF, weigh the gel portion.

For the shell portion of the toner of the present invention, it is preferred to use a polyester prepolymer having an isocyanate group to obtain a modified polyester resin (A) which can react with a compound having an active hydrogen group. Specific examples of such polyester prepolymers having an isocyanate group include a resultant obtained from a reaction of a polyester, i.e., a polycondensation compound of a polyol (1) and polycarboxylic acid (2) and having an active hydrogen group, with a polyisocyanate (3). Specific examples of such active hydrogen groups contained in the polyester mentioned above include hydroxyl group (alcoholic hydroxyl group and phenolic hydroxyl group), amino group, carboxyl group and mercapto group. Among these, alcoholic hydroxyl group is preferred.

The polyols (1) mentioned above include diols (1-1) and polyols (1-2) having three or more hydric groups. It is preferred to use a diol (1-1) alone or a mixture in which a small amount of a polyol (1-2) is added to a diol (1-1). Specific examples of diols (1-1) include alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); adducts of the bisphenols mentioned above with an alkylene oxide (e.g., ethylene oxide, propylene oxide and butylene oxide); etc. Among these compounds, alkylene glycols having from 2 to 12 carbon atoms and adducts of bisphenols with an alkylene oxide are preferred. More preferably, adducts of bisphenols with an alkylene oxide, or mixtures of an adduct of bisphenols with an alkylene oxide and an alkylene glycol having from 2 to 12 carbon atoms are used. Specific examples of the polyols (1-2) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide; etc.

Suitable polycarboxylic acids (2) include dicarboxylic acids (2-1) and polycarboxylic acids (2-2) having three or more carboxyl groups. It is preferred to use dicarboxylic acids (2-1) alone or mixtures in which a small amount of a polycarboxylic acid (2-2) is added to a dicarboxylic acid (2-1).

Specific examples of the dicarboxylic acids (2-1) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (2-2) having three or more hydroxyl groups include aromatic polycarboxylic acids having from 9 to 20 carbon atoms (e.g., trimellitic acid and pyromellitic acid).

As the polycarboxylic acid (2), anhydrides or lower alkyl esters (e.g., methyl esters, ethyl esters or isopropyl esters) of the polycarboxylic acids mentioned above can be used for the reaction with a polyol (1). Suitable mixing ratio (i.e., an equivalence ratio [OH]/[COOH]) of a polyol (1) to a polycarboxylic acid (2) ranges from 2/1 to 1/1, preferably from 1.5/1 to 1/1 and more preferably from 1.3/1 to 1.02/1.

Specific examples of the polyisocyanates (3) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisoycantes (e.g., tolylene diisocyanate and diphenylmethane diisocyanate); aromatic aliphatic diisocyanates (e.g., α, α, α', α'-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., [NCO]/[OH]) of a polyisocyanate (3) to a polyester having a hydroxyl group varies from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the content of the urea group in the modified polyesters decreases, thereby deteriorating the hot-offset resistance of the toner. The content of the constitutional component of a polyisocyanate (PIC) in the polyester prepolymer (A) having an isocyanate group at its end portion ranges from 0.5 to 40% by weight, preferably from 1 to 30% by weight and more preferably from 2 to 20% by weight. When the content is too low, the hot offset resistance of the toner deteriorates and in addition the heat resistance and low temperature fixability of the toner also deteriorate. In contrast, when the content is too high, the fixability of the toner at a low temperature deteriorates. The number of the isocyanate groups included in a molecule of the polyester prepolymer (A) is at least 1, preferably from 1.5 to 3 on average, and more preferably from 1.8 to 2.5 on average. When the number of the isocyanate group is too small (less than 1 per 1 molecule), the molecular weight of the urea-modified polyester (i) obtained after cross-linking or elongation decreases and thereby the hot offset resistance deteriorates.

It is preferred to use amines (B) serving as an elongation agent or cross-linking agent as a compound having an active hydrogen group. Specific examples of the amines (B) include diamines (B1), polyamines (B2) having three or more amino groups, amino alcohols (B3), amino mercaptans (B4), amino acids (B5), and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc. Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc.

Further, in the crosslinking reaction and/or elongation reaction of a polyester prepolymer (A) with an amine (B), a reaction inhibitor can be used if desired to control the molecular weight of the resultant urea-modified polyester resin (i). Specific examples of such a reaction inhibitor include monoamines (e.g., diethyl amine, dibutyl amine, butyl amine and lauryl amine), and blocked amines (i.e., ketimine compounds) prepared by blocking the monoamines mentioned above.

The mixing ratio (i.e., a ratio [NCO]/[NHx]) of the content of the prepolymer (A) having an isocyanate group to the amine (B) ranges from 1/2 to 2/1, preferably from 1.5/1 to 1/1.5 and more preferably from 1.2/1 to 1/1.2. When the mixing ratio is too low or too high, the molecular weight of the resultant urea-modified polyester (i) decreases, resulting in deterioration of the hot offset resistance of the resultant toner.

Further, a modified polyester (i) can be used alone or in combination in which a non-modified polyester (ii) having an acid value of from 10 to 40 mgKOH/g is added to the modified polyester (i) as a toner binder composition. By using a non-modified polyester (ii) in combination with a modified polyester (i), it is possible to improve low temperature fixability and gloss property when the toner is used in a full color image forming apparatus. In addition, since the non-modified polyester (ii) has the acid value mentioned above, viscosity fluctuation behavior accompanied with the elongation and/or cross-bridging reaction of (A) and (B) can be suitably maintained. Thereby the toner obtained can have a desired form and exhibit excellent fixability supporting a good combination of low temperature fixability and hot offset resistance.

When the acid value is too small, the elongation and/or cross-bridging reaction between (A) and (B) rapidly occur. Therefore, it is impossible to control the form, the particle diameter, the particle size distribution of a toner. In addition, since the amount of resin components which have been elongated and/or cross-bridged are large, the low temperature fixability extremely deteriorates. When the acid value is too large, the elongation reaction and/or cross-bridging reaction between (A) and (B) are not sufficient so that the viscosity of the system is too low to control the form of a toner. In addition, since the amount of resin components which have been elongated and/or cross-bridged are small, the hot offset resistance deteriorates. Further, when such a toner is used in a two-component developing system, the amount of toner spent on carrier increases. Furthermore, when such a toner is used in a single component developing system, the toner forms films on a friction charging device, etc. Thereby, friction chargeability degrades and the toner is not properly charged, resulting in background development and toner scattering occur.

When a mixture of a modified polyester with a urea-unmodified polyester is used, it is preferred that the modified polyester at least partially mix with the unmodified polyester in terms of the low temperature fixability and hot offset resistance of the resultant toner. Namely, it is preferred that the unmodified polyester (ii) has a structure similar to the polyester component of the urea-modified polyester (i). The weight ratio of the urea-modified polyester (i) to the unmodified polyester (ii) is 5/95 to 25/75, preferably 10/90 to 25/75, more preferably 12/88 to 25/75 and particularly more preferably 12/88 to /22/78. When the added amount of urea-modified polyester (i) is too small, the hot offset resistance of the resultant toner deteriorates and, in addition, it is difficult to impart a good combination of high temperature preservability and low temperature fixability to the resultant toner. The peak molecular weight of the unmodified polyester (ii) is from 1,000 to 30,000, preferably from 1,500 to 10,000 and more preferably from 2,000 to 8,000. When the peak molecular weight is too small, the high temperature preservability of the resultant toner deteriorates. When the peak molecular weight is too large, the low temperature fixability deteriorates.

The unmodified polyester (ii) of the present invention has a glass transition temperature (Tg) of from 40 to 70° C., and preferably from 45 to 55° C. When the glass transition temperature is too low, the high temperature preservability of the toner deteriorates. When the glass transition temperature is too high, the low temperature fixability becomes insufficient.

Since an unmodified polyester (ii) resin coexists with a modified polyester resin (i) obtained by cross-linking reaction and/or elongated reaction in the dry toner of the present invention, the dry toner can have a Tg of from 45 to 75° C. and preferably from 50 to 60° C. and thus have a good high temperature preservability even when the toner has a relatively low glass transition temperature compared with those of known polyester toners. The toner of the present invention preferably has a storage modulus of elasticity of 10,000 dyne/cm$^2$ at a temperature (TG') not lower than 100° C., and more preferably from 110 to 200° C. when measured at a frequency of 20 Hz. When the temperature TG' is too low, the toner has poor hot offset resistance. In addition, the toner of the present invention preferably has a viscosity of 1000 poise at a temperature (Tη) not higher than 180° C., and more preferably from 90 to 160° C. When the temperature Tη is too high, the low temperature fixability of the toner deteriorates. Namely, in view of compatibility between low temperature fixability and hot offset resistance, the temperature TG' of the toner is preferably higher than the temperature Tη, i.e., the difference between TG' and Tη (TG'−Tη) is preferably not less than 0° C. More preferably, the difference is not less than 10° C. and even more preferably not less than 20° C. There is no upper limit to the difference. However, in view of compatibility between the high temperature preservability and the low temperature fixability, the difference (TG'−Tη) is preferably from 0 to 100° C., more preferably from 10 to 90° C., and even more preferably from 20 to 80° C.

Known release agents can be used for the toner of the present invention. Suitable release agents include polyolefin waxes (e.g., polyethylene waxes and polypropylene waxes); hydrocarbons having a long chain (e.g., paraffin waxes and SASOL waxes); and waxes having a carbonyl group. Among these materials, waxes having a carbonyl group are preferably used for the toner of the present invention. Specific examples of the waxes having a carbonyl group include polyalkanoic acid esters such as carnauba waxes, montan waxes, trimethylolpropane tribehenate, pentaerythritol tetrabehenate, pentaerythritol diacetate dibehenate, glycerin tribehenate, and 1,18-octadecanediol distearate; polyalkanol esters such as tristearyl trimellitate, and distearyl maleate; polyalkanoic acid amides such as ethylenediamine dibehenylamide; polyalkylamide such as trimellitic acid tristearylamide; dialkyl ketone such as distearyl ketone; etc. Among these materials, polyalkanoic acid esters are preferred.

In the present invention, ester waxes, carnauba waxes from which free fatty acid is removed, montan waxes and oxidized rice waxes can be used alone or in combination. Among ester waxes, especially those having a branched structure have a good release effect and thus preferably used. Among carnauba waxes, those having a microcrystalline structure, an acid value not higher than 5 and a particle diameter not greater than 1 μm when dispersed in a toner binder resin, are preferred. The montan waxes mentioned above are those purified from mineral substances. Among these, same as carnauba waxes, montan waxes having a microcrystalline structure and an acid value of 5 to 14 are preferred. Oxidized rice waxes are those obtained when rice bran is air-oxidized. Its acid value is preferably 10 to 30. When the acid values of each release agent is less than the lower limit of their range, the low temperature fixation temperature rises. By contrast, when the acid values of each release agent is greater than the upper limit of their range, the cold offset temperature rises. The weight ratio of a release agent to a binder resin is 1/100 to 15/100 and preferably from 3/100 to 10/100. When the weight ratio is too small, the release agent fails to have a predetermined release effect. When the weight ratio is too large, a problem occurs that the amount of carrier spent is extremely increases.

The amount of a release agent in the toner mentioned above represents the sum of the amount added when manufacturing a toner and the amount contained in a graft polymer resin. In addition, in the binder resin mentioned above, other than a binder resin added when manufacturing a toner, the graft polymer resin and the vinyl polymer resin contained therein are contained. The binder resin mentioned in the present invention represents such a mixture resin. The melting point of the release agent in the present invention is 40 to 160° C., preferably from 50 to 120° C. and more preferably from 60 to 90° C. When the melting point of a release agent is too low, such a release agent adversely affects on the high temperature preservability of a toner. When the melting point of a release agent is too high, such a release agent causes cold offset at low temperature fixing. Further, the fusion viscosity of a release agent is preferably 5 to 1,000 cps and more preferably 10 to 100 cps when measured at a temperature 20° C. higher than its melting point. When the fusion viscosity is too high, such a release agent has little improvement effect on hot offset resistance and low temperature fixability.

The content of a release agent in a toner is normally 0 to 40% by weight and preferably from 3 to 30% by weight. The total amount of a release agent in a toner particle is obtained by Differential Scanning Calorimetry (DSC) method. Measuring is performed for a toner sample and a release agent using the following measuring devices under the following conditions. The content of the release agent is calculated by the ratio of their endotherms.

Measuring device: DSC device (DSC 60 manufactured by Shimadzu Corporation).

Amount of sample: About 5 mg

Temperature rising speed: 10° C./minute

Measuring range: room temperature to 150° C.

Measuring environment: in nitrogen gas atmosphere

The amount of a release agent is calculated using the following equation.

The total amount of a release agent (weight %)= (Endtherm (J/g) of a release agent of a toner sample)×100/(Endtherm (J/g) of a release agent)

As described in the analysis mentioned above, when a release agent is flown in the toner manufacturing process and the prearranged amount of the release agent is not contained in the toner, it is possible to determine the total amount of the release agent contained in the toner particle.

In addition, suitable colorants for use in the toner of the present invention include known dyes and pigments.

Specific examples of the colorants include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials can be used alone or in combination. The content of the colorant in the toner is preferably from 1 to 15% by weight, and more preferably from 3 to 10% by weight, based on the total weight of the toner.

Master batch dyes, which are prepared by combining a colorant with a resin, can be used as the colorant of the toner composition of the present invention. Specific examples of the resins for use in the master batch dyes or for use in combination with master batch dyes include the modified and unmodified polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins can be used alone or in combination. The master batch for use in the toner of the present invention is typically prepared by mixing and kneading a resin and a colorant upon application of high shear stress thereto. In this case, an organic solvent can be used to boost the interaction of the colorant with the resin. In addition, flushing methods in which an aqueous paste including a colorant is mixed with a resin solution of an organic solvent to transfer the colorant to the resin solution and then the aqueous liquid and organic solvent are separated to be removed can be preferably used because the resultant wet cake of the colorant can be used as it is. In this case, three-roll mills can be preferably used for kneading the mixture upon application of high shear stress thereto.

Charge controlling agent may be suitably selected for use in the toner of the present invention. To be exact, charge controlling agents can be included therein on a necessity basis. However, it is preferred to use a material having a color close to colorless or white because the color of the toner is affected when a colored material is used for a charge controlling agent. Specific examples of the charge controlling agent include known charge controlling agents such as triphenylmethane dyes, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, metal salts of salicylic acid derivatives, etc.

Specific examples of the marketed products of the charge controlling agents include BONTRON P-51 (quaternary ammonium salt), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; quinacridone, azo pigments and polymers having a functional group such as a sulfonate group, a carboxyl group, a quaternary ammonium group, etc.

The content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large a charge quantity, and thereby the electrostatic force of a developing roller attracting the toner increases, resulting in deterioration of the fluidity of the toner and a decrease of the image density of toner images.

The charge controlling agent can be dissolved or dispersed in an organic solvent after kneaded together with a master batch dye and resin. In addition, the charge controlling agent can be directly dissolved or dispersed in an organic solvent when the toner constituents are dissolved or dispersed in the organic solvent. Alternatively, the charge controlling agent may be fixed on the surface of the toner particles after the toner particles are prepared.

In addition, particulate resins can be used for the toner of the present invention. Suitable resins for use as the particulate resin of the present invention include any known resins that can form an aqueous dispersion. Specific examples of these resins include thermoplastic resins and thermosetting resins such as vinyl resins, polyurethane resins, epoxy resins, polyester resins, polyamide resins, polyimide resins, silicone resins, phenolic resins, melamine resins, urea resins, aniline resins, ionomer resins, polycarbonate resins, etc. These resins can be used alone or in combination. Among these resins, vinyl resins, polyurethane resins, epoxy resins, polyester resins, and mixtures thereof are preferably used because an aqueous dispersion including fine spherical particles can be easily prepared. Specific examples of the vinyl resins include polymers, which are prepared by polymerizing a vinyl monomer or copolymerizing vinyl monomers, such as styrene-(meth)acrylate resins, styrene-butadiene copolymers, (meth)acrylic acid-acrylate copolymers, styrene-acrylonitrile copolymers, styrene-maleic anhydride copolymers and styrene-(meth)acrylic acid copolymers.

The thus prepared toner particles can be mixed with an external additive to assist in improving the fluidity, developing property, and charging ability of the toner particles. Suitable external additives include particulate inorganic materials. It is preferred for the particulate inorganic materials to have a primary particle diameter of from 5 nm to 2 μm, and more preferably from 5 nm to 500 nm. In addition, it is preferred that the specific surface area of such particulate inorganic materials measured by a BET method is from 20 to 500 $m^2/g$. The content of the external additive is preferably from 0.01 to 5% by weight, and more preferably from 0.01 to 2.0% by weight, based on total weight of the toner.

Specific examples of such inorganic particulate materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

In addition, particulate polymers such as copolymers of polystyrene, methacrylate ester, acrylate ester, polymers prepared by polycondensation polymerization, such as silicone resins, benzoguanamine resins and nylon resin, and thermosetting resins, which can be prepared by a soap-free emulsion polymerization method, a suspension polymerization method or a dispersion polymerization method, can also be used as the external additive.

These fluidizers for use as the external additive can be subject to a surface treatment to be hydrophobized, thereby preventing the fluidity and charge properties of the toner from deteriorating even under high humidity conditions. Specific examples of the hydrophobizing agents include silane coupling agents, silylation agents, silane coupling agents including a fluoroalkyl group, organic titanate coupling agents, aluminum coupling agents, silicone oils, modified silicone oils, etc.

The toner of the present invention can include a cleanability improving agent to improve the cleaning ability thereof such that the toner remaining on an image bearing member such as photoreceptors and intermediate transfer belts can be easily removed therefrom. Specific examples of the cleanability improving agents include fatty acids and metal salts thereof such as zinc stearate, calcium stearate and stearic acid; polymer particles which are prepared by a soap-free emulsion polymerization method or the like, such as polymethyl methacrylate particles and polystyrene particles; etc. The polymer particles preferably have a narrow particle diameter distribution and the weight average particle diameter thereof is preferably from 0.01 to 1 μm.

The method of manufacturing a toner is now described. The toner of the present invention is preferably manufactured as follows: Dissolve or disperse a polymer having a portion reactive with a compound having an active hydrogen group, a release agent and a colorant; Disperse the obtained solution or the dispersion liquid in an aqueous medium; and Cross-link or elongate the polymer having a portion reactive with a compound having an active hydrogen group.

(Manufacturing Method)

A toner binder resin can be manufactured as follows; heat polyol (1) and polycarboxylic acid (2) at from 150 to 280° C. under the presence of a known esterified catalyst such as tetrabuthoxy titanate and dibutyl tin oxide; remove produced water by distillation under a reduced pressure if necessary to obtain a polyester having a hydroxyl group; and react the resultant with polyisocyanate (3) at from 40 to 140° C. to obtain prepolymer (A) having an isocyanate group; react prepolymer (A) with amine (B) at from 0 to 140° C. to obtain urea-modified polyester (i). A solvent can be used when reacting polyisocyanate (3) and reacting prepolymer (A) with amine (B). Compounds which are inactive against isocyanate (3) can be used as such solvents. Specific examples of the solvents include aromatic solvents such as toluene and xylene, ketones such as acetone, methyl ethyl ketone, methylisobutyl ketone, esters such as acetic ether, amides such as dimethylform amide and dimethyl acetamide and ethers such as tetrahydrofuran. Such a solvent can be used in combination with polyester (ii), which is a non-urea-modified polyester. In that case, after manufacturing a non-modified polyester (ii) in the same manner as in the method mentioned above for manufacturing a polyester having a hydroxyl group, the non-modified polyester (ii) is dissolved and mixed in the solvent in which reaction for obtaining urea-modified polyester (i) is finished.

The toner of the present invention can be manufactured by the following method but not limited thereto.

(Method of Manufacturing a Toner in an Aqueous Medium)

Suitable aqueous media for use in the toner manufacturing method of the present invention include water, and mixtures of water with a solvent which can be mixed with water. Specific examples of such a solvent include alcohols (e.g., methanol, isopropanol and ethylene glycol), dimethylformamide, tetrahydrofuran, cellosolves (e.g., methyl cellosolve), lower ketones (e.g., acetone and methyl ethyl ketone), etc.

It is preferred that toner particles are prepared by reacting a dispersion formed by a polyester prepolymer (A) with an amine (B) in an aqueous medium. In order to stably prepare a dispersion formed by a prepolymer (A) and a unmodified polyester resin (ii) in an aqueous medium, there is a method, for example, in which the constituent of a toner constituent including a prepolymer (A) and an non-modified polyester resin (ii) is added into an aqueous medium and then dispersed upon application of shear stress.

A prepolymer (A) and an non-modified polyester resin (ii) and other toner constituents (hereinafter referred to as toner material) such as colorants, master batch dyes, release agents and charge controlling agents can be mixed when forming the dispersion in an aqueous medium. However, it is preferred that the toner material is previously mixed and then the mixture is added into the aqueous liquid for dispersion. In addition, toner constituents such as colorants, release agents, and charge controlling agents are not necessarily added to the aqueous dispersion, but can be also added after particles are formed. For example, a colorant can be added by a known dying method to particles formed without containing a colorant.

The dispersion method is not particularly limited. Low speed shearing methods, high speed shearing methods, friction methods, high pressure jet methods, ultrasonic methods, etc. can be used. Among these methods, high speed shearing methods are preferred because particles having a particle diameter of from 2 to 20 μm can be easily prepared. At this point, the particle diameter (2 to 20 μm) means a particle diameter of particles including a liquid. When a high speed shearing type dispersion machine is used, the rotation speed is not particularly limited, but the rotation speed is typically from 1,000 to 30,000 rpm, and preferably from 5,000 to 20,000 rpm. The dispersion time is not particularly limited, but is typically from 0.1 to 5 minutes. The temperature in the dispersion process is typically from 0 to 150° C. (under pressure), and preferably from 5 to 30° C. The dispersion temperature is preferably low. This is because, when the dispersion temperature is too high, dye particles agglomerate and release agent particles come to the surface of the toner particles. In the present invention, it is possible to control the form of toner particles by suitably adjusting the conditions in the dispersion process. When the liquid is vigorously stirred, a strong shear force is provided to the dispersion (oil droplets in the aqueous medium) having a suitable viscosity. Thereby the form of toner particles becomes a spindle form and thus the form factors of the toner particles can be controlled.

In addition, the core-shell structure of a toner varies depending on dispersion state of prepolymer (A) and non-modified polyester (ii). The core-shell structure is not distinct when minutely dispersed. By contrast, when the dispersion level is low, prepolymer (A) tends to expose in the side of an aqueous solvent. Consequently, elongation reaction is performed at the interface of a toner particle, resulting in formation of a core-shell structure. The dispersion level of prepolymer (A) and non-modified polyester (ii) depends on the number of rotation of the dispersing device mentioned above, the temperature and time at dispersion, and viscosity of prepolymer (A) and non-modified polyester (ii).

The weight ratio (T/M) of the toner constituents (T) (including a prepolymer (A) and non-modified polyester resin (ii)) to the aqueous medium (M) is typically from 100/50 to 100/2,000, and preferably from 100/100 to 100/1,000. When the ratio is too large (i.e., the quantity of the aqueous medium (M) is small), the dispersion of the toner constituents in the aqueous medium is not satisfactory, and thereby the resultant toner particles do not have a desired particle diameter. In contrast, when the ratio is too small, the manufacturing costs increase.

A dispersant can be used if necessary. A dispersant is preferably used in that the particle diameter distribution of the dispersion becomes sharp and the stability of the dispersion is improved.

In the process in which a modified polyester (i) is synthesized from a polyester prepolymer (A), an elongation agent and/or cross-bridging agent (B) can be added before toner constituents are dispersed, or added after toner constituents are dispersed to start reaction with the prepolymer from the interface therebetween. In the latter case, the modified polyester resin is preferentially formed on the surface portions of the toner particles. Thus, a gradient of the concentration of the modified polyester resin can be generated in the thickness direction of a toner particle.

Specific examples of the dispersants which can be used for dispersing or emulsifying an oil phase, in which toner constituents are dissolved or dispersed, in an aqueous liquid, include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi (aminoethyl)glycin, di(octylaminoethyle)glycin, and N-alkyl-N,N-dimethyl ammonium betaine.

By using a surfactant having a fluoroalkyl group, a dispersion prepared can have good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4)sulfonate, sodium 3-{omega-fluoroalkanoyl (C6-C8)-N-ethylamino}-1-propanesulfonate, fluoroalkyl (C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl (C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants, which can be used for dispersing an oil phase including toner constituents in water, include primary, secondary and tertiary aliphatic amines having a fluoroalkyl group, aliphatic quaternary ammonium salts such as perfluoroalkyl(C6-C10) sulfoneamidepropyltrimethylammonium salts, benzalkonium salts, benzetonium chloride, pyridinium salts, imidazolinium salts, etc. Specific examples of the marketed products thereof include SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

An inorganic compound which is hardly soluble in water, such as tricalcium phosphate, calcium carbonate, titanium oxide, colloidal silica, and hydroxyapatite can also be used as the dispersant.

Other than these inorganic compounds, particulate organic resins can be used. Any particulate resins including thermoplastic resins and thermosetting resins which can form an aqueous dispersion can be used. Specific examples of these resins include thermoplastic resins and thermosetting resins such as vinyl resins, polyurethane resins, epoxy resins, polyester resins, polyamide resins, polyimide resins, silicone resins, phenolic resins, melamine resins, urea resins, aniline resins, ionomer resins, polycarbonate resins, etc. These resins can be used alone or in combination. Among these resins, vinyl resins, polyurethane resins, epoxy resins, polyester resins, and mixtures thereof are preferably used because an aqueous dispersion including fine spherical particles can be easily prepared. Specific examples of the vinyl resins include polymers, which are prepared by polymerizing a vinyl monomer or copolymerizing vinyl monomers, such as styrene-(meth)acrylate resins, styrene-butadiene copolymers, (meth)acrylic acid-acrylate copolymers, styrene-acrylonitrile copolymers, styrene-maleic anhydride copolymers and styrene-(meth)acrylic acid copolymers.

The particulate resins used have an average particle diameter of from 5 to 500 nm. When the average particle diameter is too small, toner preservability effects deteriorate. When the average particle diameter is too large, low temperature fixabiility deteriorates. In addition, it is preferred to use particulate resins having a Tg of from 55 to 100° C. When Tg is too low, the preservabiilty of a toner is not sufficient. When Tg is too high, low temperature fixabiility is not sufficient.

Further, it is possible to stabilize dispersion droplets by using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g., acrylamide, methacrylamide and diacetoneacrylamide) and their methylol compounds; acid chlorides (e.g., acrylic acid chloride and methacrylic acid chloride); and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

When compounds such as calcium phosphate soluble in an acid or alkali are used as a dispersion stabilizer, it is preferable to dissolve calcium phosphate by adding an acid such as hydrochloric acid and to wash the resultant particles with water to remove calcium phosphate therefrom. In addition, such a dispersion stabilizer can be removed using a decomposition method using an enzyme. The method of washing with water is preferred in terms of charging property of a toner. When a particulate organic resin is used as a dispersant, the dispersant is not necessarily washed away from the surface of toner particles considering improvement on high temperature preservability of the toner.

Further, to lower the viscosity of toner constituents, it is possible to use a solvent to which prepolymer (A) and non-modified polyester (ii) is soluble. Such a solvent is preferably used in that the resultant toner has a sharp particle diameter distribution. The solvent is preferably volatile and has a boiling point lower than 100° C. This is because the solvent can be easily removed from the dispersion after the particles are formed.

Specific examples of such a solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used.

The addition quantity of such a solvent is from 0 to 300 parts by weight, preferably from 0 to 100, and more preferably from 25 to 70 parts by weight, per 100 parts by weight of the prepolymer (A) used. When such a solvent is used to prepare a particle dispersion, the solvent is removed therefrom upon application of heat thereto under a normal or reduced pressure condition after the particles are subject to an elongation reaction and/or a crosslinking reaction.

The crosslinking time and/or the elongation time is determined depending on the reactivity determined by the combination of a prepolymer (A) and an amine (B) used as a crosslinking agent and/or elongation agent. However, the time is in general from 10 minutes to 40 hours, and preferably from 2 to 24 hours. The reaction temperature is generally from 0 to 150° C., and preferably from 40 to 98° C.

In addition, a known catalyst can be optionally used for promoting the reaction. Specific examples of elongation helper agents include such as dibutyltin laurate, dioctyltin laurate and tertiary amine compounds. As for the toner of the present invention, tertiary amine compounds are preferred. Any tertiary amine compounds can be used. Among these, the following compound represented by the following chemical formula 1 is preferred.

Chemical formula 1

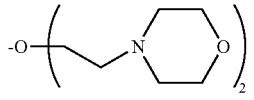

In order to remove the organic solvent from the thus prepared emulsion (dispersion), a drying method, in which the temperature of the emulsion is gradually increased to evaporate the organic solvent from the drops dispersed in the emulsion, can be used. The organic solvent is preferably removed under the condition that the content ratio of the oil phase solid portion in the dispersion liquid is from 5 to 50%, the temperature of the solvent remover is from 10 to 50° C. and the accumulation time of the toner during solvent removing is within 30 minutes. Alternatively, a drying method in which the emulsion is sprayed in a dry atmosphere to evaporate and remove not only the organic solvent in the drops in the emulsion but also the remaining aqueous medium can be used. The dry atmosphere can be prepared by heating gases such as air, nitrogen, carbon dioxide and combustion gases. The temperature of the heated gases is preferably higher than the boiling point of the solvent having the highest boiling point among the solvents used in the emulsion. By using spray dryers, belt dryers, rotary kilns, etc., as a drying apparatus, the drying treatment can be completed in a short period of time.

When the thus prepared toner particles still have a wide particle diameter distribution even after the particles are subjected to a washing treatment and a drying treatment, the toner particles are preferably subjected to a classification treatment so that the toner particles have a desired particle diameter distribution. The classification operation can be performed in a dispersion liquid using a cyclone, a decanter, or a method utilizing a centrifuge to remove fine particles therefrom. It is also possible to classify dried toner powder particles. Considering efficiency, it is preferred to subject the liquid including the particles to the classification treatment. The toner particles having an undesired particle diameter can be returned to the kneading process for reuse even when the toner particles are still in a wet condition.

It is preferred to remove the dispersant used from the particle dispersion liquid and further preferred to perform the dispersant removal when classifying toner particles.

The thus prepared toner powder particles after drying can be mixed with other kinds of particles such as release agents, charge controlling agents, fluidizing agents and colorants. Such other particles can be fixed and integrated into the surface of toner particles by applying a mechanical impact thereto. Thus the other kinds of particles can be prevented from being separated from the toner particles.

Specific examples of such mechanical impact application methods include methods in which a mixture is mixed with a high speed rotation blade and methods in which a mixture is put into a jet air to collide the particles against each other or a collision plate. Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

Further, in the toner of the present invention, there is no particular limit to the size thereof. To obtain good image quality excellent in fine line reproducibility, the weight average particle diameter (Dv) of the toner of the present invention is from 2.5 to 8.0 μm and preferably from 3.0 to 7.0 μm. The ratio (Dv/Dn) of the weight average particle diameter (Dv) to the number average particle diameter (Dn) is not greater than 1.25 and preferably from 1.10 to 1.25. Such a dry toner is excellent in high temperature preservability, low temperature fixability and hot offset resistance. Especially when such a dry toner is used in a full color copier, images obtained have an excellent gloss. Further, when such a dry toner is used for a two component developer while a cyclic operation of consumption and replenishment of the toner is repeatedly performed in an extended period of time, the particle diameter of the toner particles in the two component developer hardly changes, and thereby stable development can be performed (i.e., good images can be stably produced) for a long period of time even if the toner is repeatedly agitated in the developing device in an extended period of time.

In addition, when the toner is used as a single component developer and is consumed and replenished, the variance of the toner particle is relatively less. Also the toner does not cause problems such that a toner film is formed on the developing roller used and the toner adheres to a member such as blades configured to regulate the toner to form a thin toner layer. Therefore, even when the toner is repeatedly agitated in a developing device in a long period of time, its development and image quality are stable and good.

In general, the smaller the toner particle diameter, the better the resultant image quality. However, the smaller the toner particle diameter, the worse the transferability and cleaning property of the toner. When the toner has a weight average particle diameter smaller than the lower limit of the toner of the present invention, the toner tends to adhere to the surface of the carrier included in a two component developer. Therefore, when the developer is repeatedly agitated in a developing device for a long period of time, the charging ability of the carrier deteriorates. When a toner having such a small particle diameter is used as a single component developer, the toner tends to cause problems such that a toner film is formed on a developing roller and such that the toner adheres to a member such as blades configured to regulate the toner to form a thin toner layer.

The same phenomena are true for the case in which the content ratio of fine toner particles in a toner is above the range for the toner of the present invention. In contrast, when the weight average particle diameter of the toner is greater than the limit for the toner of the present invention, it is difficult to produce high resolution and high quality images. In addition, the particle diameter of the toner greatly changes when a cyclic operation of consumption and replenishment of the toner is repeatedly performed. Also it is confirmed that the same is applied to the case in which the ratio Dw/Dn is greater than 1.25.

The average particle diameter and size distribution of a toner can be measured using COULTER COUNTER TA-II and COULTER MULTI-SIZER II (both manufactured by Beckman Coulter, Inc.). In the present invention, COULTER COUNTER MULTI-SIZER II is connected to an interface (manufactured by the institute of Japanese Union of Science and Engineers) and a PC9801 personal computer (manufactured by NEC Corporation) to measure the number distribution and volume distribution.

Figure 2A:
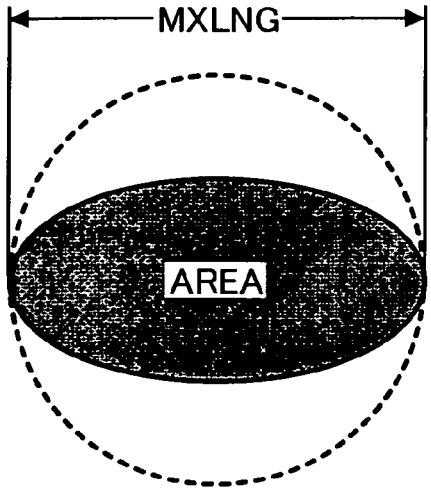
FIGS. 2A and 2B are schematic diagrams illustrating form factors SF-1 and SF-2 of a toner particle, respectively.
Figure 2B:
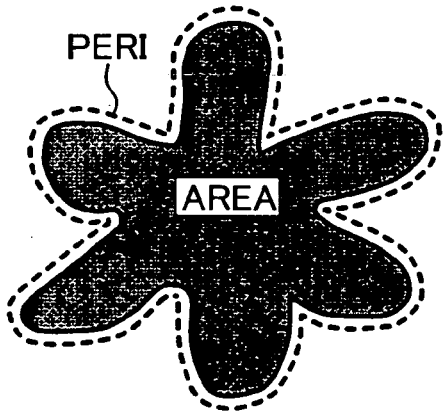

In addition, the toner of the present invention preferably has a form factor SF-1 of from 100 to 180 and a form factor of SF-2 of from 100 to 180. FIGS. 2A and 2B are schematic diagrams for explaining the form factors SF-1 and SF-2.

The form factor SF-1 represents the degree of roundness of a toner particle and is defined by the following relationship (1):

$$SF\text{-}1=\{(MXLNG)^2/(\mathrm{AREA})\}\times(100\pi/4) \quad (1),$$

wherein, MXLNG represents a diameter of the circle circumscribing the image of a toner particle obtained, for example, by observing the toner particle with a microscope, and AREA represents the area of the image.

When a toner has a form factor SF-1 close to 100, that is, the toner has a form close to a true sphere, the contact between toner particles and between toner particles and the image bearing member becomes a point to point contact. Thereby the adhesion force between the toner particles weakens and therefore, the toner has a good fluidity. In addition, the adhesion force between the toner particles and the image bearing member is also weak and the transfer rate of the toner is high. When the form factor SF-1 of a toner is too high, the form thereof is irregular. This is not preferred because developability and transferability of the toner deteriorate.

The form factor SF-2 represents the degree of concavity and convexity of a toner particle and is defined by the following relatiosihp (2):

$$SF\text{-}2=\{(PERI)^2/(\mathrm{AREA})\}\times(100/4\pi) \quad (2),$$

wherein, PERI represents the peripheral length, or perimeter, of the image of a toner particle observed, for example, by a microscope; and AREA represents the area of the image.

When the form factor SF-2 gets close to 100, the toner has a surface with less concavity and convexity. To improve cleaning performance, the surface of a toner can have a suitable roughness. However, when the form factor SF-2 is too large, the roughness of the surface is significant. Such a toner is not preferred because, when using such a toner, the image quality deteriorates due to toner scattering, etc.

The form factors SF-1 and SF-2 are determined by the following method:

(1) photographs of at least 500 toner particles are taken with a magnifying power of 1,000 using a scanning electron microscope (S-800, manufactured by Hitachi Ltd.)

(2) image data are made by scanning the photographs with a scanner; and (3) the image data are binarized and analyzed using an image analyzer (LUSEX 3 manufactured by Nireco Corp.) to obtain the form factors.

The toner of the present invention has a substantially sphere form, which can be determined by the following form description.

Figure 3A:
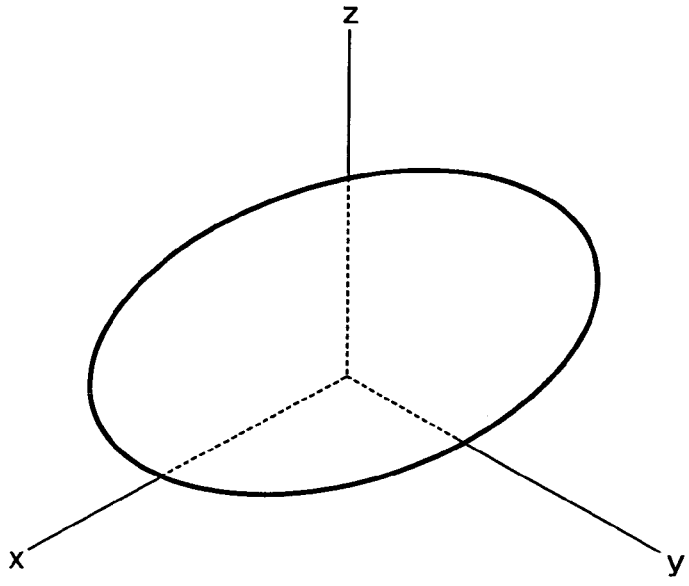
FIGS. 3A to 3C are diagrams illustrating an example of the toner of the present invention.
Figure 3B:
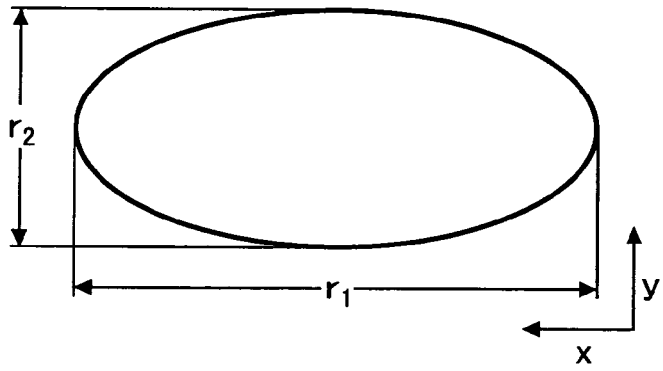
Figure 3C:
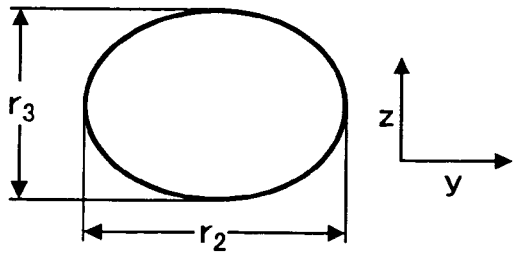

FIGS. 3A to 3C are schematic diagrams illustrating the form of the toner particle of the present invention. When the form of the toner particle of the present invention illustrated in FIG. 3A is determined by its major axis (r1), its minor axis (r2) and its thickness (r3) while these three factors satisfy the following relationship: r1>or=r2>or=r3, the ratio of r2 to r1 (refer to FIG. 3B) is preferably from 0.5 to 1.0 and the ratio of r3 to r2 (refer to FIG. 3C) is preferably from 0.7 to 1.0. When the ratio of r2/r1 is too small, the form of the toner particles is away from a sphere form so that the toner tends to be insufficient in dot representation and transfer efficiency, resulting in formation of low quality images.

When the ratio of r3/r2 is too small, the toner form is closer to a flat form so that, unlike the case of a toner having a sphere form, a high transfer rate is not obtained. When the ratio of r3/r2 is 1.0, the toner particle revolves around the major axis thereof and the fluidity thereof can be improved.

The particle dimensions, r1, r2 and r3 of the toner can be determined by taking photographs of the toner particles using a scanning electron microscope (SEM) while observing the particles from different angles.

The toner of the present invention can be used in a two component developer in which the toner is mixed with a magnetic carrier. The weight ratio of the toner in a developer is preferably from 1 to 20%. Suitable carriers for use in such two component developers include any known carrier materials such as iron powders, ferrite powders, magnetite powders, magnetic resin carriers, which have a particle diameter of from about 20 μm to about 200 μm. The surface of the carriers may be coated with a resin. Specific preferred examples of such resins to be coated on the carriers include amino resins such as urea-formaldehyde resins, melamine resins, benzoguanamine resins, urea resins, and polyamide resins, and epoxy resins. In addition, polyvinyl or polyvinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, fluoroterpolymers such as terpolymer of tetrafluoroethylene, vinylidenefluoride and other monomers including no fluorine atom, and silicone resins can be used.

If desired, an electroconductive powder may be included in the coating resin. Specific preferred examples of such electroconductive powders include metal powders, carbon blacks, titanium oxides, tin oxides, and zinc oxides. The average particle diameter of such electroconductive powders is preferably not greater than 1 μm. When the particle diameter is greater than 1 μm, it is hard to control the resistance thereof.

The toner of the present invention can also be used as a single component magnetic developer or a single component non-magnetic developer, which does not include a carrier.

The above mentioned toner can be used in an image forming apparatus 100.

Figure 4:
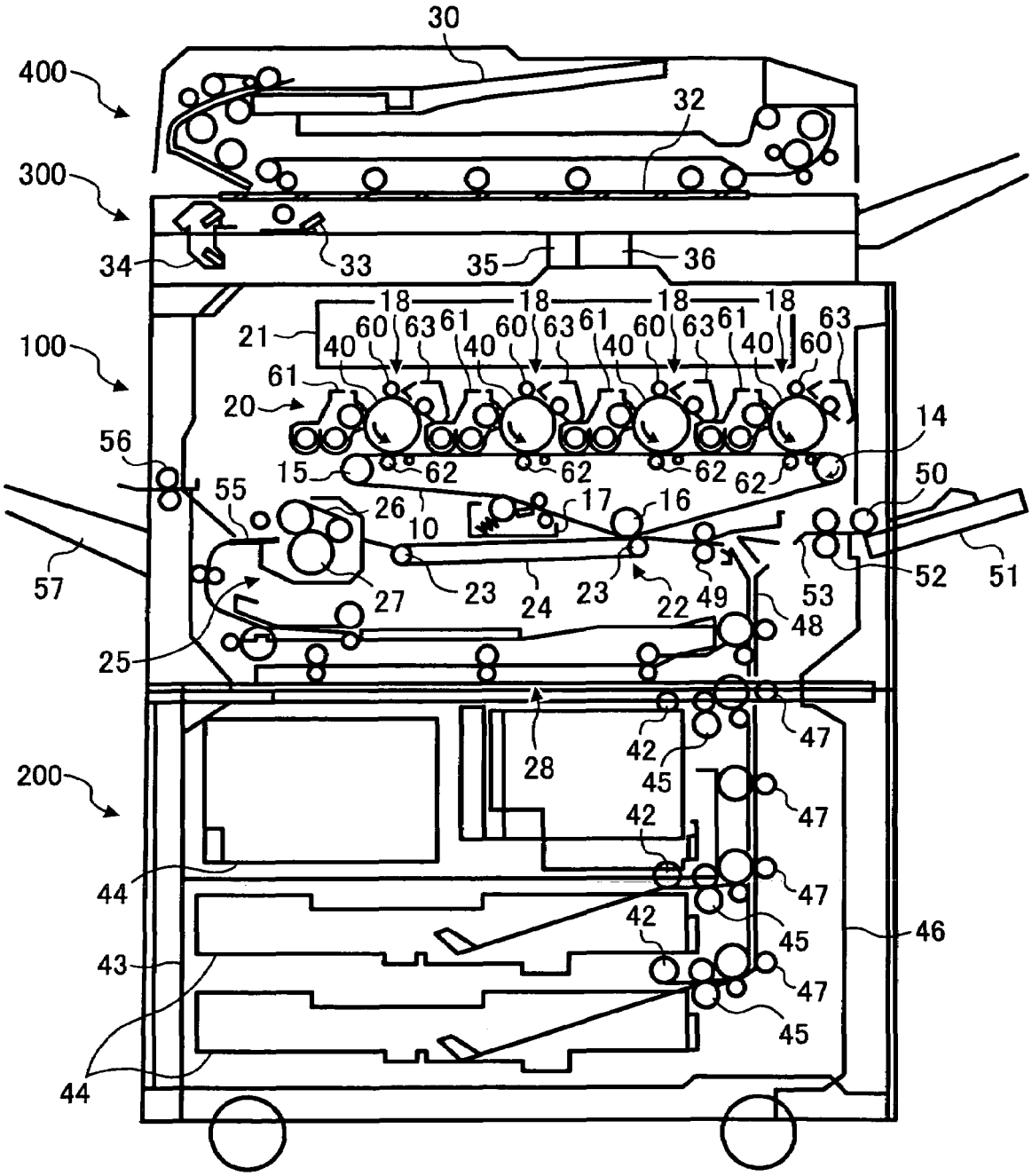
FIG. 4 is a schematic diagram illustrating an embodiment of the tandem type image bearing member taking an indirect transfer system of the present invention.

FIG. 4 is a diagram illustrating an embodiment of the image forming apparatus of the present invention and a schematic diagram illustrating an embodiment of the tandem-type image forming apparatus using an indirect transfer manner.

The image forming apparatus 100 at least contains a paper feed table 200, a scanner 300 provided onto the image forming apparatus and an automatic document feeder (ADF) 400 further provided onto the scanner 300. An intermediate transfer device 10 including transfer rollers 62 is located in the center of the image forming apparatus 100. The intermediate transfer device is suspended over three supporting rollers 14, 15, and 16 so as to be able to rotate clockwise for transfer as illustrated in FIG. 4. In this figure, to the right-hand side of the second supporting roller 15 among these three rollers, an intermediate transfer device cleaner 17 is provided to remove residual toner on the intermediate transfer device 10 after an image transfer. On the portion of the intermediate transfer device 10 suspended between the first supporting roller 14 and the second supporting roller 15, four image forming devices 18 for four colors of black, yellow, magenta and cyan are arranged in the transfer direction of the intermediate transfer device 10 to form an tandem type image forming device 20. These image forming devices 18 can be a process cartridge including an image bearing member 40 and at least one processing device selected from the group consisting of a charging device 60, a developing device 61 and a cleaning device 63. The process cartridge integrally supports these devices and is detachably attached to the image forming apparatus 100. Thereby, when a toner is necessary to be replenished, it is possible to integrally replace the process cartridge, resulting in an increase of convenience of a user. Above the tandem type image forming device 20, an irradiation device 21 is provided. Further, a secondary transfer device 22 is located such that the intermediate transfer device 10 is sandwiched between the tandem type image forming device 20 and the secondary transfer device 22. In this figure, the secondary transfer device 22 contains an endless secondary transfer belt 24 suspended over two rollers 23 and is pressed to the third supporting roller 16 by way of the intermediate transfer device 10 to transfer the image on a sheet on the intermediate transfer device 10. To the side of the secondary transfer device 22, a fixing device 25 is provided to fix the transferred image on the sheet. The fixing device 25 contains a fixing belt 26 having an endless form and a pressing roller 27 which is pressed to the fixing belt 26. The secondary transfer device 22 has a function of transferring a sheet having a transferred image thereon to the fixing device 25. Although the secondary transfer device 22 can be structured to have a transfer roller and a non-contacting charger, such a secondary transfer device is difficult to have this sheet transferring function.

In FIG. 4, under the secondary transfer device 22 and the fixing device 25, a sheet reversing device 28 is located parallel to the tandem type image forming devices 20 to reverse a sheet for recording an image on both sides of the sheet. The procedure of photocpoying a document with this color electrophotographic apparatus is as follows: a document is set on a document table 30 of an automatic document feeder 400, or the automatic document handler 400 is opened and a document is set on a contact glass 32 of a scanner 30 and the automatic document handler 400 is closed to hold down the document; by pressing a start button (not shown), after the document is first transferred to the contact glass 32 when the document is set on the automatic document feeder 400, the scanner 300 is driven to scan the document on the contact glass 32 with a first scanning unit 33 and a second scanning unit 34; the document is irradiated with light from the first scanning unit 33; reflection light from the document is redirected at the first scanning unit 33 to the second scanning unit 34; the redirected light is reflected at the mirror of the second scanning unit 34 to a reading sensor 36 through an image focusing lens 35 to read the content of the document; also by pressing the start button (not shown), one of the supporting rollers 14, 15 and 16 is driven by a driving motor (not shown) and the rest two supporting rollers are driven thereby, thereby rotating the intermediate transfer device 10; at the same time, each of image forming devices 18 rotates respective image bearing members 40 to form a single color image of black, yellow, magenta and cyan thereon; each single color image is sequentially transferred onto the intermediate transfer device 10 to form an overlapped color image as the intermediate transfer device 10 moves along; also, by pressing the start button (not shown), one of paper feeding rollers 42 in the paper feeding table 200 is selectively rotated and sheets of paper are pulled out from one of paper feeder cassettes 44 located in a multiple-stage manner in a paper bank 43; the sheets of paper are separated one by one by a separation roller 45 and guided to a paper feeding route 46; the sheet is transferred by transfer rollers 47 to a paper feeding route 48 in the center of the image forming apparatus 100; the sheet is stopped at a registration roller 49; or sheets on a manual paper feeding tray 51 are pulled out by rotating a paper feeding roller 50 and are separated one by one by a separation roller 52 and guided to a manual paper feeding route 53; similarly the sheet is stopped at the registration roller 49; then the registration roller 49 is rotated to the timing of the overlapped color image on the intermediate transfer device 10 to feed the sheet to between the intermediate transfer device 22 and the secondary transfer device 22; the overlapped color image is transferred to the sheet by the secondary transfer device 22; the sheet having the overlapped color image thereon is transferred by the secondary transfer device 22 to a fixing device 25; the transferred image on the sheet is fixed at the fixing device 25 upon application of heat and pressure; the sheet is switched at a switching claw 55 and discharged by an output roller 56 to an output tray 57; or the sheet is switched at a switching claw 55 to the sheet reversing device 28 and reversed thereat and guided to the transfer position again and after an image is recorded on the other side of the sheet, the sheet is discharged by the output roller 56 to the output tray 57; after transferring the image, the intermediate transfer device cleaner 17 removes residual toner on the intermediate transfer device 10 in order for the intermediate transfer device 10 to be ready for the next image forming cycle.

When the toner of the present invention used for the image forming apparatus 100 is accommodated in the developing device 60 located in the image forming apparatus 100 for a long period of time, the quality of the toner is stable without blocking and therefore quality images can be provided. In addition, since a release agent included in the toner particle is present near the surface thereof, the minimum fixing temperature can be lowered and the frequency of the occurrence of offset becomes less.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis of Emulsion of Resin Particles

In a reaction container equipped with a stirrer and a thermometer, 683 parts of water, 11 parts of a sodium salt of sulfate of an adduct of methacrylic acid with ethyleneoxide (EREMINOR RS-30 manufactured by Sanyo Chemical Industries Ltd.), 83 parts of styrene, 83 parts of methacrylic acid, and 1 part of ammonium persulfate were added and the mixture was agitated for 15 minutes at a revolution of 400 rpm. As a result, a white emulsion was obtained. Then the emulsion was heated at 75° C. to perform a reaction for 5 hours. Then 30 parts of a 1% aqueous solution of ammonium persulfate were added to the emulsion and the mixture was further aged for 5 hours at 75° C. Thus, an aqueous dispersion (particulate dispersion 1) of a vinyl resin (i.e., a copolymer of styrene-methacrylic acid—a sodium salt of a sulfate of an adduct of methacrylic acid with ethyleneoxide) was prepared.

The volume average particle diameter of the particulate dispersion 1 was 105 nm when measured with LA-920 (manufactured by Horiba Ltd.). In addition, a portion of the particulate dispersion was dried and its resin component was isolated. The glass transition temperature Tg of the resin component was 59° C. and the weight average particle diameter thereof is 1,500,000.

Preparation of Aqueous Phase

Eighty (80) parts of Particle dispersion 1 were mixed with 990 parts of water, 37 parts of a 48.5% aqueous solution of sodium dodecyldiphenyletherdisulfonate (EREMINOR MON-7 manufactured by Sanyo Chemical Industries, Ltd.), and 90 parts of ethyl acetate and a translucent white liquid (Aqueous phase 1) was obtained.

Synthesis of Ketimine

In a reaction container equipped with a stirrer and a thermometer, 170 parts of isophoronediamine and 75 parts of methyl ethyl ketone were mixed. The mixture was reacted for 5 hours at 50° C. and a blocked amine (Ketimine compound 1) was obtained. Ketimine compound 1 has an amine value of 418.

Preparation of Master Batch

One thousand two hundred (1200) parts of water, 40 parts of carbon black (REGAL® 400R manufactured by Cabot Corporation, and 60 parts of a polyester resin were mixed in a Henshel mixer (manufactured by Mitsui Mining Company, Limited). This mixture was kneaded for 30 minutes at 150° C. using a two-roll mill followed by rolling and cooling. Then the kneaded mixture was pulverized to obtain Carbon black master batch 1 was prepared.

Synthesis of Modified Resin (Release Agent Dispersant)

In an autoclave reaction container equipped with a stirrer and a thermometer, 450 parts of xylene and 150 parts of low molecular weight polyethylene functioning as a release agent (SANWAX LEL-400 having a softening point of 128° C. manufactured by Sanyo Chemical Industries, Ltd.) were fully dissolved. Subsequent to nitrogen replacement, a mixture solution containing 594 parts of styrene, 255 parts of methyl methacrylate, 34.3 parts of di-t-butylperoxyhexahydroterephthalate and 120 parts of xylene was dribbled at 155° C. for two hours for polymerization. Further, the resultant was maintained at this temperature for one hour. After removing the solvents, a modified resin (a) having an average ester group condensation of 13.2%, a number average molecular weight of 3300, a weight average molecular weight of 12,000 and a glass transition temperature of 65.2° C. was obtained.

Preparation of Oil Phase

In a reaction container equipped with a stirrer and a thermometer, 400 parts of Low molecular weight polyester 1 having a number average molecular weight of 6900, a weight average molecular weight of 21,500, a glass transition temperature of 44° C. and an acid value of 24, 110 parts of carnauba wax, 11 parts of the modified resin (a) and 947 parts of ethyl acetate were mixed. The mixture was agitated at 80° C. for 5 hours and then cooled down to 30° C. in 1 hour. Then 500 parts of Master batch 1 and 500 parts of ethyl acetate were added to the reaction container and mixed for 1 hour. Toner constituent solution 1 was thus prepared.

Then 1,324 parts of Toner constituent solution 1 were transferred into a container, and then dispersed using a bead mill (ULTRAVISCOMILL® manufactured by AIMEX) under the following conditions:

Liquid feeding speed: 1 kg/hr,

Disc rotation speed: 6 m/sec,

Diameter of beads (zirconium): 0.5 mm,

Filling factor: 80% by volume, and

Number of dispersion treatment: 3 times.

The release agent was thus dispersed. Then 1,324 parts of a 65% ethyl acetate solution of Low molecular weight polyester 1 were added thereto, and the mixture was dispersed under the conditions mentioned above except that the number of the dispersion treatment was changed to 1 time. Dye and release agent dispersion liquid 1 was thus prepared.

Emulsification

The following components were contained in a container to be mixed for 1 minute using a TK HOMOMIXER (manufactured by Tokushu Kika Kogyo Co., Ltd.) at a rotation number of 5,000 rpm.

| | |
|---|---|
| Dye and release agent dispersion liquid 1 | 1,610 |
| 50% ethyl acetate solution of Prepolymer 1 (number average molecular weight: 9,800, weight average molecular weight: 21,500, Glass transition temperature: 65° C., acid value: 1.5) | 231 |
| Elongation helping agent (UCAT660M manufactured by San Apro Ltd.) | 5.5 |
| Ketimine compound 1 | 8.5 |

Then, 1,200 parts of Aqueous phase 1 were added thereto and the mixture was mixed for 20 minutes using a TK HOMOMIXER at a rotation number of 13,000 rpm to obtain Emulsion slurry 1.

Removing Organic Solvent

In a container equipped with a stirrer and a thermometer, Emulsion slurry 1 was added and heated at 30° C. for 8 hours to remove the solvents therefrom. The resultant was further aged at 45° C. for 4 hours to obtain Dispersion slurry 1 from which the organic solvent was removed.

Washing and Drying

One hundred (100) parts of Emulsion slurry 1 were filtered under a reduced pressure. Then the following operations were performed.

(1) 100 parts of deionized water were added to the thus prepared filtration cake and the mixture was mixed for 10 minutes by a TK HOMOMIXER at a rotation number of 12,000 rpm and then filtered;

(2) 100 parts of a 10% aqueous solution of sodium hydroxide were added to the cake prepared in (1) and the mixture was mixed for 30 minutes by a TK HOMOMIXER at a rotation number of 12,000 rpm and then filtered under a reduced pressure;

(3) 100 parts of a 10% hydrochloric acid were added to the cake prepared in (2) and the mixture was mixed for 10 minutes by a TK HOMOMIXER at a rotation number of 12,000 rpm and then filtered; and (4) 300 parts of deionized water were added to the cake prepared in (3) and the mixture was mixed for 10 minutes by a TK HOMOMIXER at a rotation number of 12,000 rpm and then filtered. This washing was repeated twice to obtain a filtered cake. The filtered cake was dried for 48 hours at 45° C. using a circulating drier. The obtained dried cake was sieved using a screen having openings of 75 μm to obtain Toner mother particle 1.

Mixing of External Additive

One hundred (100) parts of Toner mother particle 1, 1.0 parts of hydrophobic silica (HDK H2000 manufactured by Clariant Japan Ltd.) and 0.5 parts of hydrophobic titanium oxide were mixed in a Henschel mixer. The mixture was sieved with a sieve having a mesh of 38 μm to obtain Toner 1 by removing flocculant production.

Comparative Example 1

The toner of Comparative Example 1 was manufactured in the same manner as illustrated in Example 1 except that, in the oil phase preparation process, 400 parts of Low molecular weight polyester 1 (number average molecular weight: 6,900, weight average molecular weight: 15,500, glass transition temperature: 44° C., acid value: 24, 70 parts of carnauba wax, 28 parts of Modified resin (a) and 947 parts of ethyl acetate were mixed instead and, in the emulsification process, 231 parts of 50% ethyl acetate solution of Prepolymer 1 (number average molecular weight: 9,800, weight average molecular weight: 15,000, glass transition temperature: 60° C., acid value: 0.5) were thrown in instead.

The toner was evaluated based on the following.

(Evaluated Items)

1) Fixability (Hot Offset Property and Low Temperature Fixability)

An image forming apparatus (remodeled based on Imagio Neo 450 manufactured by Ricoh, Co., Ltd.) having a belt fixing system was used to evaluate fixability of solid images having an amount of toner attachment of from 0.9 mg/cm$^2$ to 1.1 mg/cm$^2$ on a plain transfer paper (Type 6200 manufactured by Ricoh Co. Ltd.) or a heavy weight transfer paper (copy print paper <135> manufactured by NBS Ricoh Co., Ltd.). Fixation test was performed while the temperature of the fixing belt was changed. The temperature at which hot offset did not occur for plain transfer paper was defined as the upper limit of the fixation temperature. The lowest temperature of fixation was measured for a heavy weight transfer paper. The lowest temperature of fixation was defined as a temperature at the fixing roller at which the remaining ratio of the image density after an image was rubbed by a pad was not less than 70%. Preferably, the upper limit of fixation temperature was not lower than 200° C. and the lowest temperature of fixation was not higher than 140° C.

2) Environment Preservability (Thermal Preservation)

Penetration level of a toner was measured by a penetrometer as follows: Measure 10 g of a toner; Set the toner in a 20 ml glass vessel; Tap the glass vessel 100 times; Leave the glass vessel in a constant-temperature bath set at a temperature of 55° C. and at a humidity of 80% for 24 hours; and measure the penetration level of the toner with a penetrometer. In addition, the penetration level of a toner preserved in a low temperature (10° C.) and low humidity (15%) environment was also measured. The toner having a relatively low penetration level among the toner preserved in the high temperature and humidity environment and the toner preserved in the low temperature and humidity environment was evaluated. The evaluation was as follows:

Excellent: not less than 20 mm

Good: not less than 15 mm and less than 20 mm

Fair: not less than 10 mm and less than 15 mm

Bad: less than 10 mm.

3) Temperature at which Efflux of Toner Starts

The temperature at which efflux of a toner starts was measured as follows:

After running 1,000 sheets having 100% image area (i.e., 100% solid image) using an IMAGIO NEO 450 manufactured by Ricoh Co. Ltd., remove the cleaning roller in contact with the pressing belt; and run Type 6200 paper manufactured by Ricoh Co. Ltd. and copy print paper <135> manufactured by NBS Ricoh Co., Ltd. while raising the temperature of the fixing roller in a fixing tester. The temperature at which the toner started fusing on paper was measured.

The properties of the toner obtained from Example 1 and Comparative Example 1 are shown in Table 1.

TABLE 1

| | Volume average particle diameter (μm) | Dispersion level (Dv/Dn) | Tm1 (° C.) | Tm2 (° C.) | Content ratio of release agent | Glass transition temperature |
|---|---|---|---|---|---|---|
| Example 1 | 5.8 | 1.18 | 152.1 | 132.8 | 13.2 | 46.2 |
| Comparative Example 1 | 5.8 | 1.20 | 137.5 | 131.8 | 5.8 | 45.1 |

Also the evaluation results of the toners obtained from Example and Comparative Example 1 are shown in Table 2.

TABLE 2

| | Hot offset occurring temperature | Lower limit temperature of fixation | Thermal Preservation | Temperature at which toner efflux starts |
|---|---|---|---|---|
| Example 1 | Not lower than 220° C. | 135° C. | Excellent | No efflux |
| Comparative Example 1 | 190° C. | 135° C. | Fair | Efflux started at 180° C. |

As seen in Tables 1 and 2, since the toner obtained from Example 1 has a relatively high half efflux temperature Tm1 compared with the toner obtained from Comparative Example 1, the toner obtained from Example 1 has a relatively good thermal preservability compared with the toner obtained from Comparative Example 1. In addition, since the kneaded toner half efflux temperatures Tm2 for the toners obtained from Example 1 and Comparative Example 1 are almost the same, the lower limit temperatures of fixation for both toners are almost the same. However, the toner obtained from Example 1 contains more amount of a release agent and thus the hot offset temperature thereof is extremely high, resulting in restraint of occurrence of hot offset. Further, the temperature at which the toner starts efflux is high because the core-shell structure of the toner restrains an extreme efflux of resins having a low softening point and the wax on the surface of the toner functions as a release agent between the toner on the cleaning roller and the fixing roller or the fixing belt.

This document claims priority and contains subject matter related to Japanese Patent Applications No. 2004-081162 filed on Mar. 19, 2004, incorporated herein by reference.

Having now fully described embodiments of the present invention, it will be apparent to one of ordinary skill in the art that many changes and modifications can be made thereto without departing from the spirit and scope of embodiments of the invention as set forth herein.

The invention claimed is:

1. A toner, comprising:

toner particles having a core-shell structure, and comprising:

a binder resin;

a colorant; and a release agent, wherein the toner satisfies the following relationship: $\Delta Tm = Tm1 - Tm2 > 10°$ C., wherein Tm1 represents half efflux temperature of the toner and Tm2 represents half efflux temperature of a toner which is prepared by melting and kneading the toner particles and wherein a content of the release agent in the area 0.3 μm deep down from the toner surface of the toner particles is from 7 to 30% by volume based on the entire area 0.3 μm deep down from the toner surface of the toner particles when the content is determined by Fourier Transform Infrared Spectroscopy Attenuated Total Reflection (FTIR-ATR) method.

2. The toner according to claim 1, wherein the core portion of the toner particle comprises a low molecular weight polyester resin and the shell portion of the toner particle comprises a high molecular weight polyester resin.

3. The toner according to claim 2, wherein a weight ratio of the low molecular weight polyester resin to the high molecular weight polyester resin is from 5/100 to 30/100.

4. The toner according to claim 2, wherein the low molecular weight polyester resin has a peak molecular weight of from 1,000 to 30,000.

5. The toner according to claim 2, wherein the low molecular weight polyester resin has an acid value of from 10 to 40 mg KOH/g.

6. The toner according to claim 2, wherein the low molecular weight polyester resin has a glass transition temperature (Tg) of from 40 to 70° C.

7. The toner according to claim 1, wherein the toner has a glass transition temperature (Tg) of from 45 to 75° C.

8. The toner according to claim 1, wherein Tm1 is from 145 to 200° C. and Tm2 is from 110 to 135° C.

9. The toner according to claim 1, wherein the weight ratio of the release agent in the toner particle is from 3/100 to 20/100 when measured by differential scanning calorimetry (DSC) method.

10. The toner according to claim 1, wherein at least a polymer having a portion reactive with a compound having an active hydrogen group is used as a precursor to form the toner particles through cross-bridge reaction with a cross bridging agent or elongation reaction with an elongation agent.

11. The toner according to claim 10, wherein the cross-bridging agent or the elongation agent is a tertiary amine compound.

12. The toner according to claim 1, wherein the toner particle has a volume average particle diameter (Dv) of from 3.0 to 8.0 μm and a ratio (Dv/Dn) of the volume average particle diameter (Dv) to a number average particle diameter (Dn) is from 1.00 to 1.40.

13. The toner according to claim 12, wherein the toner particle has a form factor SF-1 of from 100 to 180 and a form factor of SF-2 of from 100 to 180.

14. The toner according to claim 12, wherein the toner particle has a spindle form determined by a major axis length r1, a minor axis length r2 and a thickness length r3, wherein a ratio (r2/r1) of the minor axis length r2 to the major axis length r1 is from 0.5 to 1.0 and a ratio of (r3/r2) of the thickness length r3 to the minor axis length r2 is from 0.7 to 1.0.

15. The toner according to claim 1, wherein the toner particle has an average circularity not less than 0.94.

16. A fixing device comprising:

a fixing roller configured to fix an image visualized by a toner on a recording material upon application of at least one of heat and pressure;

a pressing roller configured to fix the toner image on the recording material upon application of at least one of heat and pressure; and a cleaning roller configured to clean at least one of the fixing roller and the pressing roller, wherein the toner comprises toner particles having a core-shell structure and comprising a binder resin, a colorant, and a release agent, wherein the toner satisfies the following relationship: ΔTm=Tm1−Tm2>10° C., wherein Tm1 represents half efflux temperature of the toner and Tm2 represents half efflux temperature of a toner which is prepared by melting and kneading the toner particles and wherein a content of the release agent in the area 0.3 μm deep down from the toner surface of the toner particles is from 7 to 30% by volume based on the entire area 0.3 μm deep down from the toner surface of the toner particles when the content is determined by Fourier Transform Infrared Spectroscopy Attenuated Total Reflection (FTIR-ATR) method.

17. The fixing device according to claim 16, wherein the core of the toner particle comprises a low molecular weight polyester resin and the shell of the toner particle comprises a high molecular weight polyester resin.

18. An image forming apparatus comprising:

an image bearing member configured to bear a latent electrostatic image;

a charging device configured to uniformly charge a surface of the image bearing member;

an irradiating device configured to irradiate the surface of the image bearing member with light based on image data and to write the latent electrostatic image thereon;

a developing device configured to visualize the latent electrostatic image borne on the surface of the image bearing member with a toner;

a transfer device configured to transfer the visualized image on the surface of the image bearing member to a recording medium;

a cleaning device configured to remove residual toner on the image bearing member; and a fixing device configured to fix the visualized toner image on the recording medium upon application of at least one of heat and pressure, the fixing device comprising a fixing roller, a pressing roller and a cleaning roller configured to clean the one of the fixing roller and the pressing roller, wherein the toner comprises toner particles having a core-shell structure and comprising a binder resin, a colorant, and a release agent, wherein the toner satisfies the following relationship: ΔTm=Tm1−Tm2>10° C., wherein Tm1 represents half efflux temperature of the toner and Tm2 represents half efflux temperature of a toner which is prepared by melting and kneading the toner particles and wherein a content of the release agent in the area 0.3 μm deep down from the toner surface of the toner particles is from 7 to 30% by volume based on the entire area 0.3 μm deep down from the toner surface of the toner particles when the content is determined by Fourier Transform Infrared Spectroscopy Attenuated Total Reflection (FTIR-ATR) method.

19. The image forming apparatus according to claim 18, wherein the core portion of the toner particle comprises a low molecular weight polyester resin and the shell portion of the toner particle comprises a high molecular weight polyester resin.

* * * * *